United States Patent [19]

Wild

[11] 4,034,499

[45] July 12, 1977

[54] FLEXIBLE TUBE WITH INTERNAL RIDGES FOR PRODUCING MUSICAL SOUND

[76] Inventor: John J. Wild, 1100 E. 36th St., Minneapolis, Minn. 55407

[21] Appl. No.: 69,285

[22] Filed: Sept. 3, 1970

[51] Int. Cl.[2] ..... A63H 5/00

[52] U.S. Cl. ..... 46/52; 46/178

[58] Field of Search ..... 46/52, 178, 179, 44; 138/21; 285/179

[56] References Cited

U.S. PATENT DOCUMENTS

| | | | |
|---|---|---|---|
| 2,637,141 | 5/1953 | De Nisco | 46/52 |
| 3,076,669 | 2/1963 | Schlein | 285/179 |
| 3,266,455 | 8/1966 | Cohn | 46/175 R |
| 3,313,319 | 4/1967 | Osborn et al. | 138/121 |

OTHER PUBLICATIONS

New Yorker, July 11, 1970 issue, p. 21.

*Primary Examiner*—F. Barry Shay
*Attorney, Agent, or Firm*—Warren A. Sturm; James R. Haller

[57] ABSTRACT

A hollow, open ended tube of flexible, semirigid material which has internally projecting ridges that are so shaped and positioned as to produce a musical tone when air flow is induced through the tube by holding it at one end and swinging the other end around in a generally circular path to create a pressure differential between the two ends of the tube or by mounting the tube on the exterior of a vehicle in line with the relative airstream when the vehicle is in motion. The tube may be attached at one end to a hollow, extensible, spring-loaded handle.

2 Claims, 7 Drawing Figures

INVENTOR.
JOHN J. WILD
BY
Carlsen Carlsen + Sturm
ATTORNEYS

FLEXIBLE TUBE WITH INTERNAL RIDGES FOR PRODUCING MUSICAL SOUND

BACKGROUND OF THE INVENTION

Musical toys have been made in the past in which a hollow tube is held at one end and swung around in a generally circular path to induce a flow of air through the tube and produce a musical tone by activating a vibrating reed or whistle element mounted within the tube. One example of such a musical toy is disclosed in U.S. Pat. No. 2, 637,141 which is issued to De Nisco on May 5, 1953, for a "Musical Toy." Referring to FIG. 1 of the De Nisco patent, air flow is induced through a tube 12 by swinging the tube around in a generally circular path to generate a differential pressure between its two open ends 13 and 15. When the tube 12 is rotated about pin 11, the linear velocity of the ends of the tube will be equal to $2\pi$ LW, where L is the distance between the end of the tube and pin 11, and W is the rotary speed at which the tube is rotated. Accordingly, in the embodiment illustrated in FIG. 1 of the De Nisco patent, end 15 of tube 12 will travel at approximately twelve times the linear velocity of end 13 when the tube is rotated about pin 11. It is well known to those skilled in the art that a flow of air transverse to the open end of a tube causes a decrease in pressure at the end of the tube which is directly proportional to the velocity of air flow. Therefore, the above noted differential of speed will produce a corresponding differential of pressure between the two ends 13 and 15 of tube 12, which in turn induces a flow of air from end 13 to end 15 and activates the whistle element 14 within tube 12.

Although the above noted prior art musical toy has proven successful in performing its intended function, it is subject to several serious limitations in that its vibrating reed or whistle structure inherently limits its tone to a single fixed frequency regardless of the amount of air flow, and the musical quality of the tone tends to be relatively thin and non-resonant in quality due to the small size of the vibrating reed or whistle structure. In addition, the utilization of a fixed pivot point for the rotating tube necessarily limits the size of the tube, which in turn limits the volume of the sound that can be obtained and prevents the tone of the vibrating reed or whistle assembly from being enriched by any significant overtones generated within the tube. Accordingly, the principal object of this invention is to provide a novel musical toy which is capable of producing richer, more resonant musical tones than the above noted prior art toy and which is capable of producing tones that can be varied in frequency and amplitude as opposed to being limited to a fixed frequency and amplitude.

SUMMARY OF THE INVENTION

In accordance with this invention, it has been found that a relatively rich musical tone which has a pleasant booming quality, and which is variable in amplitude and in frequency, can be produced in an open ended tube of flexible, semirigid material by providing internally projecting ridges or corrugations that are so shaped and positioned as to produce turbulent eddies that reinforce each other in a periodic manner when air flow is induced through the tube so as to generate a musical tone whose frequency and amplitude varies in accordance with the velocity of the air flow. In one embodiment of the invention, the tube is curled in the shape of a ram's horn and is attached to a clamp so that it can be mounted on the exterior of a bicycle or motor vehicle in line with the relative airstream when the vehicle is in motion. In this embodiment of the invention, the frequency and amplitude of the resulting musical tone varies in accordance with the speed of the vehicle with respect to the surrounding air mass. In another embodiment of the invention, the tube is adapted to be held at one end and swung in a generally circular path around the head of the user to induce a flow of air therethrough. In this embodiment of the invention, the frequency and amplitude of the resulting musical tone can be controlled by varying the speed at which the tube is swung. In addition, the frequency of the musical tone in the hand held embodiment can also be controlled by means of a spring loaded extensible handle which permits the length of the tube to be varied at will. The detailed construction and operation of these two embodiments is described below in connection with the attached drawings.

DESCRIPTION OF THE DRAWINGS

FIG. 1 is a side view of one embodiment of the invention which is adapted to be mounted on a bicycle or a motorized vehicle.

DESCRIPTION OF THE INVENTION

Figures 2, 3, 4, 5, 6, 7, 9:
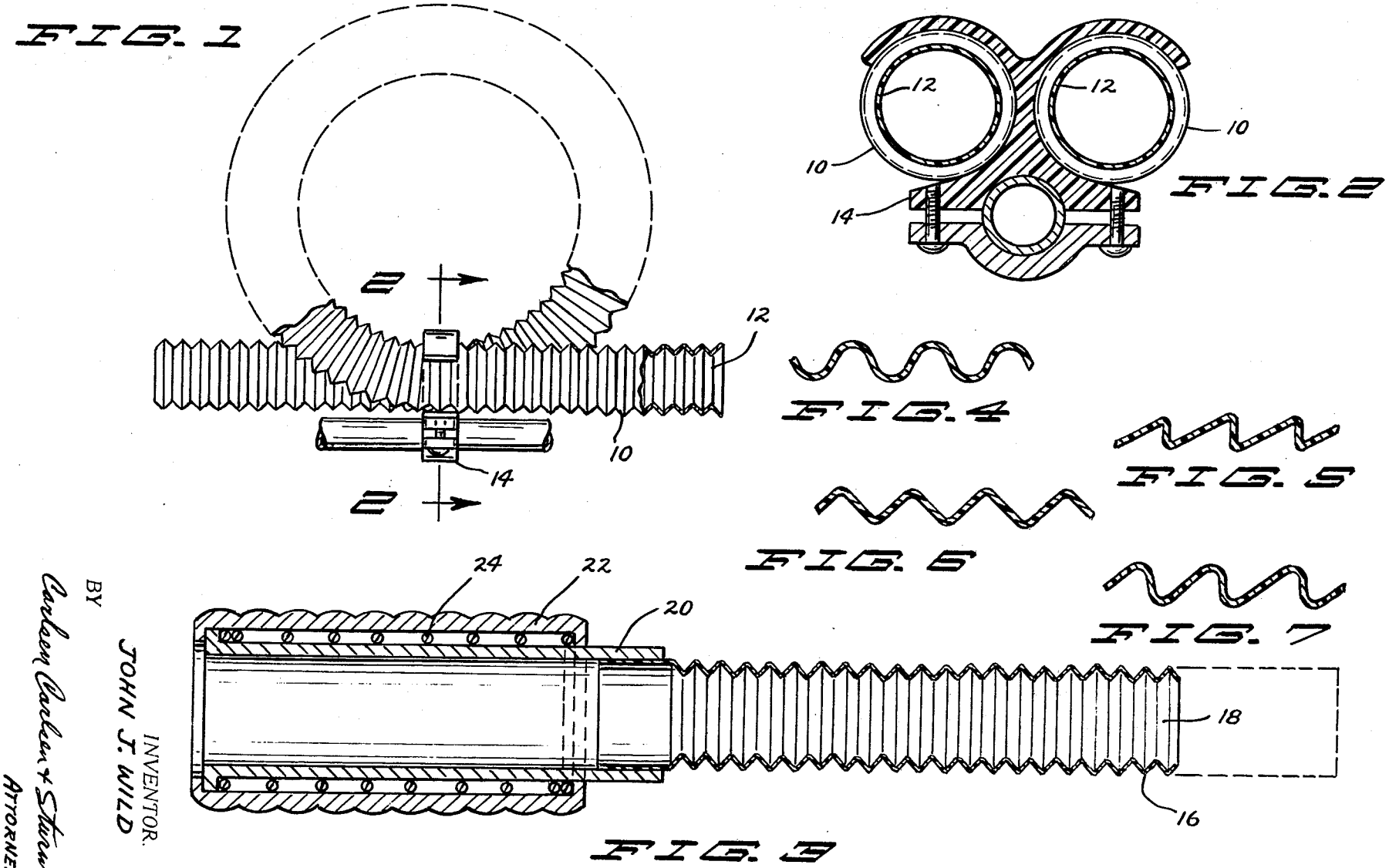
FIG. 2 is a cross sectional view taken on the plane 2—2 of FIG. 1.
FIG. 3 is an axial cross sectional view of a second embodiment of the invention which is adapted to be used by hand.
FIG. 4 is a fragmentary cross sectional view showing one illustrative geometric configuration for the internally projecting ridges or corrugations of this invention.
FIG. 5 is a fragmentary cross sectional view showing a second geometric configuration for the internally projecting ridges or corrugations of this invention.
FIG. 6 is a fragmentary cross sectional view showing a third geometric configuration for the internally projecting ridges or corrugations of this invention.
FIG. 7 is a fragmentary cross sectional view showing a fourth geometric configuration for the internally projecting ridges or corrugations of this invention.

Referring to FIG. 1, one illustrative embodiment of the invention comprises a corrugated, bellows-like tube 10 which is made of a flexible, semirigid material such as polyethylene plastic or the like. The tube 10 is open at both ends and contains a plurality of equally spaced, inwardly projecting, annular ridges 12 which are shaped and positioned to produce turbulent eddies that reinforce each other in a periodic manner when air flow is induced through the tube so as to produce a musical tone whose frequency and amplitude varies in accordance with the velocity of the air flow. Although the exact physical cause for the phenomenon is still in the hypothetical stage, it has been found by experiment that such a tube structure will produce a relatively rich musical tone which has a pleasant booming quality, and further that the frequency and amplitude of the tone will vary in accordance with the velocity of the air stream passing through the tube. It is presumed that this musical tone results from a periodic reinforcement of turbulent eddies which interact with the main air stream to progressively modulate the main air stream as it passes through the tube, thus producing standing waves which resonant the tube structure at audible frequencies. In any event, it has been found by experiment that suitable tones will be produced when the ridges 12 are sufficiently high to produce appreciable turbulence in the air stream. In the disclosed embodiment a ridge height of 3/16 inch has been found adequate to produce good tones in a polyethylene tube having an inside diameter of 1⅛ inches, a wall thickness of 1/32 inches, a spaceing between the ridges of ¼ inch, and a length of approximately 36 inches. In this particular embodiment of the invention, the flexible tube 10 is coiled in the shape of a ram's horn and is maintained in that shape by means of a clamp structure 14 for securing the coiled tube to a bicycle or motor vehicle. It has been found by experiment that this embodiment will produce musical tones ranging in frequency from 329.6 cycles per second to 1,318.5 cycles per second at orificial air stream velocities ranging from 10 to 50 miles per hour.

FIGS. 4, 5, 6, and 7 show various possible geometric configurations for the internally projecting ridges or corrugations 12. Although each of these geometrical shapes will produce musical tones, it has been found by experiment that the air foil shape shown in FIG. 7 produces somewhat better tones than the other shapes.

The embodiment shown in FIG. 1 can also be utilized as a hand-held tone generator when it is removed from the clamp 14. As a hand-held tone generator, the tube 10 is grasped at one end and swung about in a generally circular path to induce a differential pressure between the two ends of the tube and thus to induce air flow through the tube. The velocity of the air flow through the tube depends upon the speed at which it is swung, and since the frequency and amplitude of the musical tone varies in accordance with the velocity of the air flow, it is possible for the user to control the frequency and amplitude of the musical tone by varying the speed at which the tube is swung.

FIG. 3 shows a second embodiment of the invention comprising a corrugated, bellows-like tube 16 which is made of a flexible, semirigid material such as polyethylene plastic or the like, and which contains a plurality of spaced, inwardly projecting annular ridges or corrugations 18. Tube 16 is attached at one end to an extensible hollow handle which comprises an inner sleeve member 20, an outer sleeve member 22 which is slidably mounted over the inner sleeve 20, and an expansion spring 24 which extends between a flange on the lower end of inner sleeve 20 and a flange on the opposing end of the outer sleeve 22 so as to normally hold the two sleeves in a collapsed or retracted position. The dimensions for the tube 16 and inwardly projecting ridges or corrugations 18 are the same in the embodiment of FIG. 3 as those given above for the embodiment of FIG. 1. In the embodiment of FIG. 3, however, the extensible handle provides a further means of controlling the frequency of the tone by varying the length of the tube. When the embodiment shown in FIG. 3 is grasped by the outer sleeve 22 and swung about the head of the user, the extensible handle will reach a certain length for any given speed in accordance with the centrifugal force generated at that particular speed, and the overall structure will produce a tone whose frequency and amplitude depends on the velocity of air flow through the tube and on the length of the extensible handle. For any given rotary speed of the tube, the frequency of the resulting tone can be varied at will by shaking the extensible handle as it it swung so as to vary the length of the tube and thereby to modulate the frequency of the tone.

From the foregoing description, it will be clear that this invention provides a simple, inexpensive musical toy which is capable of producing a relatively rich, resonant musical tone that can be varied in frequency and amplitude as opposed to being limited to a fixed frequency and amplitude. And although this invention has been described in connection with two specific embodiments thereof, it should be understood that the invention is by no means limited to the disclosed embodiments since many modifications can be made in the disclosed embodiments without altering their basic principle of operation. For example, though the disclosed tubes are shown as being corrugated in a bellows-like manner by a plurality of spaced, annular ridges, it is possible to achieve the same effect with a continuous helical ridge that winds around the tube with approximately the same spacing between turns as is shown between the spaced, annular ridges. In addition, it will be apparent to those skilled in the art that the velocity of air flow through the tube could be controlled by means of a variable diameter orifice on the extensible handle if desired, and also that the effective acoustic length of the handle might be varied by means of a plurality of spaced air holes which are positioned to be manually opened or closed while the tube is being swung. These and many other modifications of the disclosed structure will be apparent to those skilled in the art, and this invention includes all modifications falling within the scope of the following claims.

I claim:

1. A tone generator comprising a hollow tube which is open a both ends, a plurality of spaced, inwardly projecting ridges within the hollow interior of said tube, said ridges being shaped and positioned to produce a musical tone in response to the passage of an air stream through said tube, said tube being comprised of a flexible, semirigid material which is capable of being resonated at audible frequencies and sufficiently flexible to be grasped at one end and swung about the head of a user, and further comprising a hollow spring-loaded extensible handle attached to one end of said tube.

2. A tone generator comprising a hollow tube which is open at both ends, a plurality of spaced, inwardly projecting ridges within the hollow interior of said tube, said ridges being shaped and positioned to produce a musical tone in response to the passage of an air stream through said tube, said tube being comprised of a flexible, semiridig material which is capable of being resonated at audible frequencies, said tube being made of polyethylene plastic having a wall thickness of approximately 1/32 inch, an inside diameter of approximately 1⅛inches, and a length of approximately 36 inches, and wherein the height of said inwardly projecting ridges is approximately 3/16 inch and the spacing between said inwardly projecting ridges is approximately ¼ inch.

* * * * *